US008389832B2

(12) United States Patent
Niskanen

(10) Patent No.: US 8,389,832 B2
(45) Date of Patent: Mar. 5, 2013

(54) MUSICAL BALLOON ACCESSORIES

(76) Inventor: Will Niskanen, Minneapolis, MN (US)

( * ) Notice: Subject to any disclaimer, the term of this patent is extended or adjusted under 35 U.S.C. 154(b) by 0 days.

(21) Appl. No.: 12/931,076

(22) Filed: Jan. 24, 2011

(65) Prior Publication Data

US 2011/0179936 A1 Jul. 28, 2011

Related U.S. Application Data

(60) Provisional application No. 61/336,663, filed on Jan. 26, 2010.

(51) Int. Cl.
*G10F 1/08* (2006.01)

(52) U.S. Cl. ..... 84/94.1

(58) Field of Classification Search ..... 84/94.1, 84/94.2, 95.1, 95.2; 446/267, 268
See application file for complete search history.

(56) References Cited

U.S. PATENT DOCUMENTS

2003/0190967 A1* 10/2003 Henry ..... 472/128

* cited by examiner

*Primary Examiner* — Kimberly Lockett
(74) *Attorney, Agent, or Firm* — Thrasher Associates

(57) ABSTRACT

The hanging musical attachment device is an attachment to an inflatable balloon that adds ornamental features allowing the balloon to hang as an ornament creating additional appeal to generic balloon and adding the accompaniment of a musical playing device. This attachment can be used with balloons without the need for helium, because the attachment is the means of support for the balloon. The interchangeable balloons allow for the musical device to be replaced without the need to replace the entire device.

11 Claims, 3 Drawing Sheets

MUSICAL BALLOON ACCESSORIES

CLAIM OF PRIORITY

This Application claims priority to U.S. Provisional Patent Application No. 61/336,663 to common inventor Niskanen, dated 26 Jan. 2010 and entitled The Hanging Musical Attachment Device.

FIELD OF THE INVENTION

The present invention relates to balloon accessories.

PROBLEM STATEMENT

Interpretation Considerations

This section describes the technical field in more detail, and discusses problems encountered in the technical field. This section does not describe prior art as defined for purposes of anticipation or obviousness under 35 U.S.C. section 102 or 35 U.S.C. section 103. Thus, nothing stated in the Problem Statement is to be construed as prior art.

DISCUSSION

Some balloons have the electronic music boxes, usually contained within the interior of the balloon ("musical balloons"). However, musical balloons have not been entirely acceptable to the trade for a variety of reasons. The electronic music boxes generally include a mechanical switch which must be activated before music plays, and it is often difficult to operate the mechanical switch.

Additionally, musical balloons typically utilize helium to inflate the balloon. However, helium can be expensive and requires a special regulator to inflate the balloon. Also, the helium generally deflates in a few hours rendering the balloon practically useless. Therefore, there is the need for a balloon accessory that provides for easy access to a music box switch.

BRIEF DESCRIPTION OF THE DRAWINGS

Various aspects of the invention, as well as an embodiment, are better understood by reference to the following detailed description. The detailed description, given by way of examples and not intended to limit the present invention solely thereto, will be better understood when read in conjunction with the drawings wherein like reference numerals denote like elements and parts in which.

EXEMPLARY EMBODIMENT OF A BEST MODE

Interpretation Considerations

Figure 1:
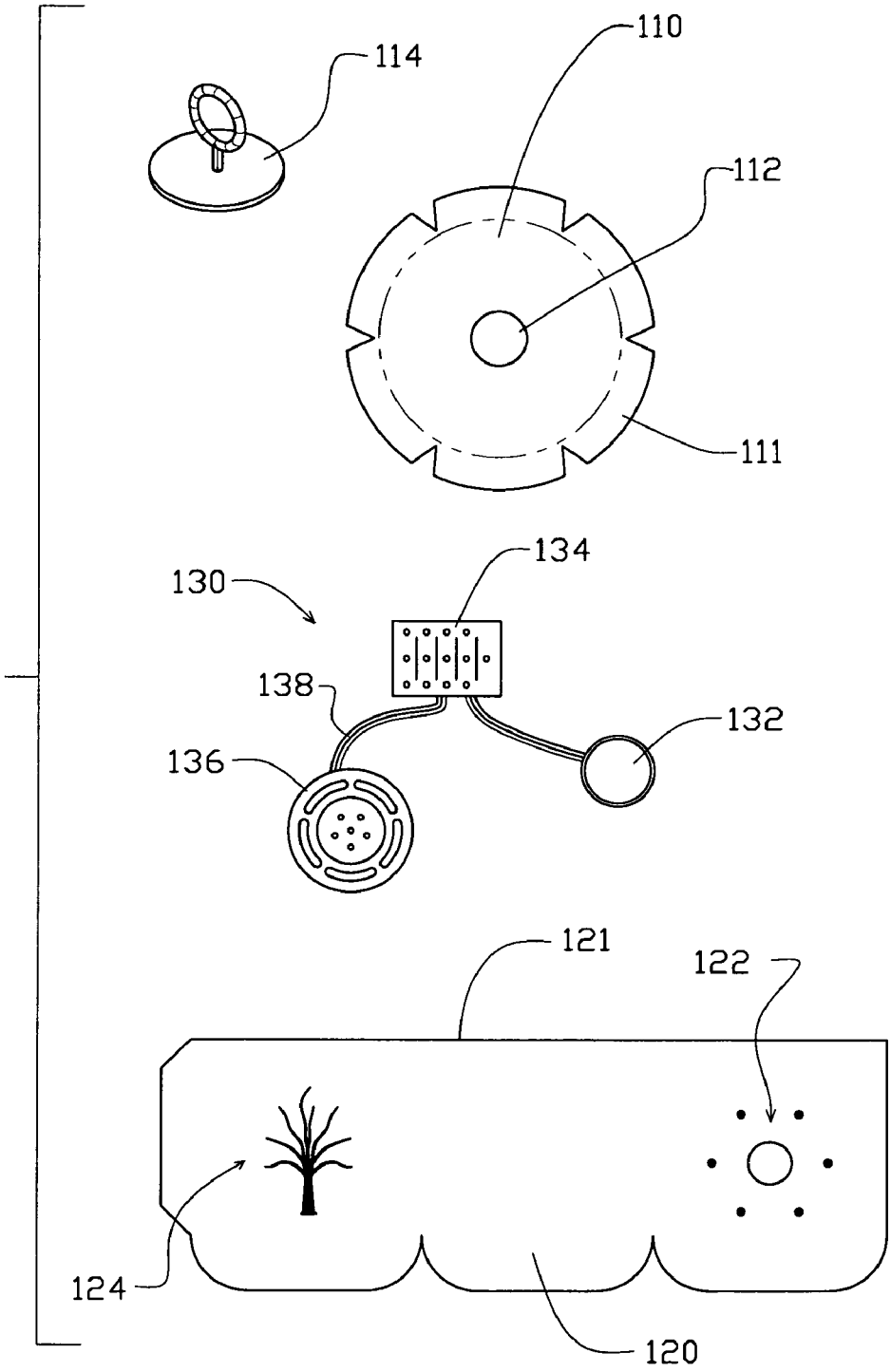
FIG. 1 is a view of the components that when assembled, form the apparatus according to the teachings of the invention.

When reading this section (An Exemplary Embodiment of a Best Mode, which describes an exemplary embodiment of the best mode of the invention, hereinafter "exemplary embodiment"), one should keep in mind several points. First, the following exemplary embodiment is what the inventor believes to be the best mode for practicing the invention at the time this patent was filed. Thus, since one of ordinary skill in the art may recognize from the following exemplary embodiment that substantially equivalent structures or substantially equivalent acts may be used to achieve the same results in exactly the same way, or to achieve the same results in a not dissimilar way, the following exemplary embodiment should not be interpreted as limiting the invention to one embodiment.

Likewise, individual aspects (sometimes called species) of the invention are provided as examples, and, accordingly, one of ordinary skill in the art may recognize from a following exemplary structure (or a following exemplary act) that a substantially equivalent structure or substantially equivalent act may be used to either achieve the same results in substantially the same way, or to achieve the same results in a not dissimilar way.

Accordingly, the discussion of a species (or a specific item) invokes the genus (the class of items) to which that species belongs as well as related species in that genus. Likewise, the recitation of a genus invokes the species known in the art. Furthermore, it is recognized that as technology develops, a number of additional alternatives to achieve an aspect of the invention may arise. Such advances are hereby incorporated within their respective genus, and should be recognized as being functionally equivalent or structurally equivalent to the aspect shown or described.

Second, the only essential aspects of the invention are identified by the claims. Thus, aspects of the invention, including elements, acts, functions, and relationships (shown or described) should not be interpreted as being essential unless they are explicitly described and identified as being essential. Third, a function or an act should be interpreted as incorporating all modes of doing that function or act, unless otherwise explicitly stated (for example, one recognizes that "tacking" may be done by nailing, stapling, gluing, hot gunning, riveting, etc., and so a use of the word tacking invokes stapling, gluing, etc., and all other modes of that word and similar words, such as "attaching").

Fourth, unless explicitly stated otherwise, conjunctive words (such as "or", "and", "including", or "comprising" for example) should be interpreted in the inclusive, not the exclusive, sense. Fifth, the words "means" and "step" are provided to facilitate the reader's understanding of the invention and do not mean "means" or "step" as defined in §112, paragraph 6 of 35 U.S.C., unless used as "means for-functioning-" or "step for-functioning-" in the Claims section. Sixth, the invention is also described in view of the Festo decisions, and, in that regard, the claims and the invention incorporate equivalents known, unknown, foreseeable, and unforeseeable. Seventh, the language and each word used in the invention should be given the ordinary interpretation of the language and the word, unless indicated otherwise. As will be understood by those of ordinary skill in the art, various structures and devices are depicted in block diagram form in order to avoid unnecessarily obscuring the invention.

It should be noted in the following discussion that acts with like names are performed in like manners, unless otherwise stated. Of course, the foregoing discussions and definitions are provided for clarification purposes and are not limiting. Words and phrases are to be given their ordinary plain meaning unless indicated otherwise.

DETAILED DESCRIPTION OF THE DRAWINGS

The hanging musical accessory device combines any inflatable balloon to create an entirely new product: an interactive musical ornament that looks perfectly appropriate in an upside-down position. Further, a decorative enclosure cap is made of printed cardstock, plastic, metal corrugated plastic, or other suitable materials, is fastened to the stem of a balloon. Similar to a greeting card, an electronic sound module is sandwiched in the enclosure. When a balloon is no longer able to hold air or helium, or the user wants to change out the balloon for color, size, or other reasons, the balloon can be discarded and the accessory can be attached to a another balloon. If the musical device no longer works properly or the battery has died, the musical device or battery can be replaced respectively without rendering the entire accessory useless.

Shown in FIG. 1 are the components of the inventive accessory 100. The accessory 100 generally comprises a generally circular top piece 110 having an outside rim 111 and a stem hole 112 therethrough. The top piece 110 is coupled to a support siding 120 having a top edge 121 and a plurality of audio holes 123. The support siding 120 has a top edge 121 which is couplable to the outside edge 111 of the top piece 110 to create a three dimensional cap (illustrated in FIGS. 2 and 3). The support side 120 may include ornamental cuts 122, or designs 124 for additional appeal. Now, it can be seen that a balloon stem can be pulled through the stem hole 112 and affixed to the cap in any manner known to those of skill in the art.

A coupling 114 is integrated with the cap 110. Accordingly, shown in FIG. 1 is a coupling embodied as a simple molded plastic closed loop hook 114. Thus, the coupling 114 may serve as both an ornament hook as well as an anchor for a balloon stem. Further, the coupling 114 can be an open loop hook or a closed loop hook. The coupling 114 in its various embodiments allows the apparatus to be attached to a tree, walls, hangers, and other support devices, including hands. The music comes from a common music box 130, which typically includes a battery 132 electrically coupled to an integrated circuit tone modulator 134 and a speaker 136 by a cord 138. Accordingly, the music box is attached on the inside of the cap in a manner known to those of skill in the art.

Figure 2:
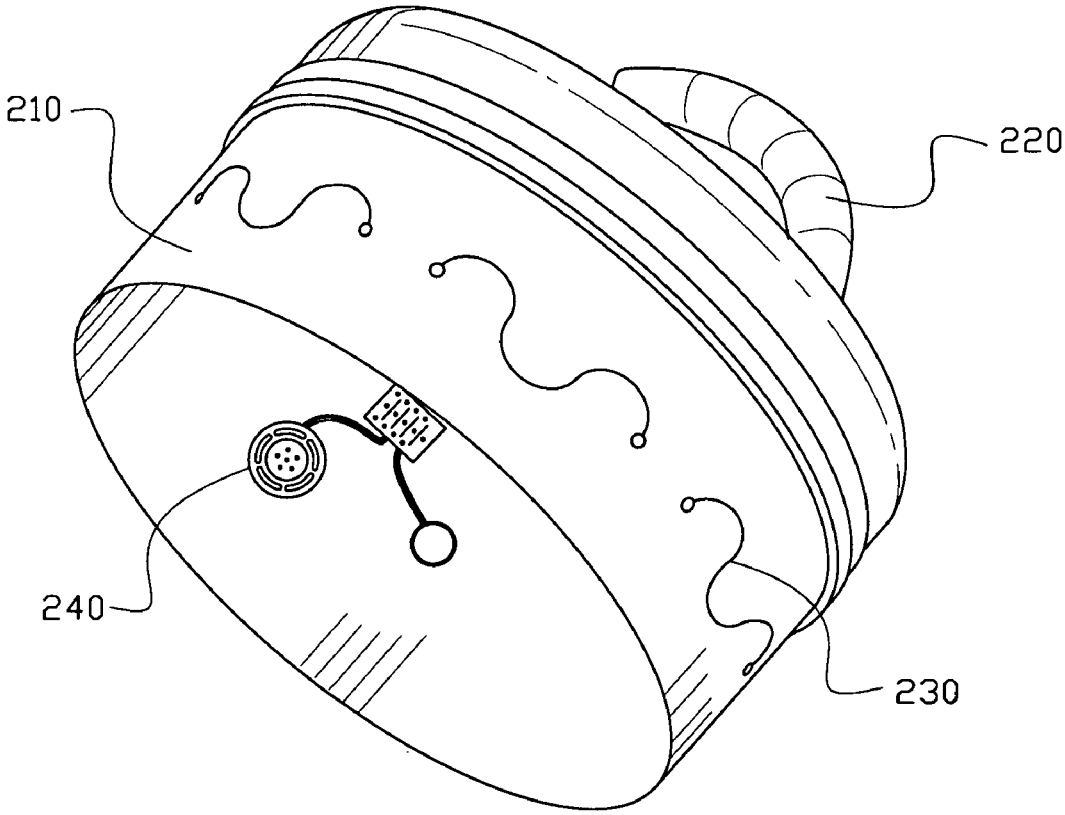
FIG. 2 is an isometric view from beneath the cap that attaches to the balloon showing the side of the cap and the inside of the cap.

FIG. 2 illustrates a cap 210 having a coupling 220 embodied as an open hook 220, with each of the accessory attachment's major elements shown "in situ." Ornamental designs 230 are illustrated and traverse about the support siding 232, which add fashionable appeal. Affixed to the inside the cap 210 is a music box 240 (which may be affixed to any portion (s) of the cap 210. In this configuration, the cap 210 may fit over the stem-portion of an inflatable balloon as illustrated in FIG. 3.

Figure 3:
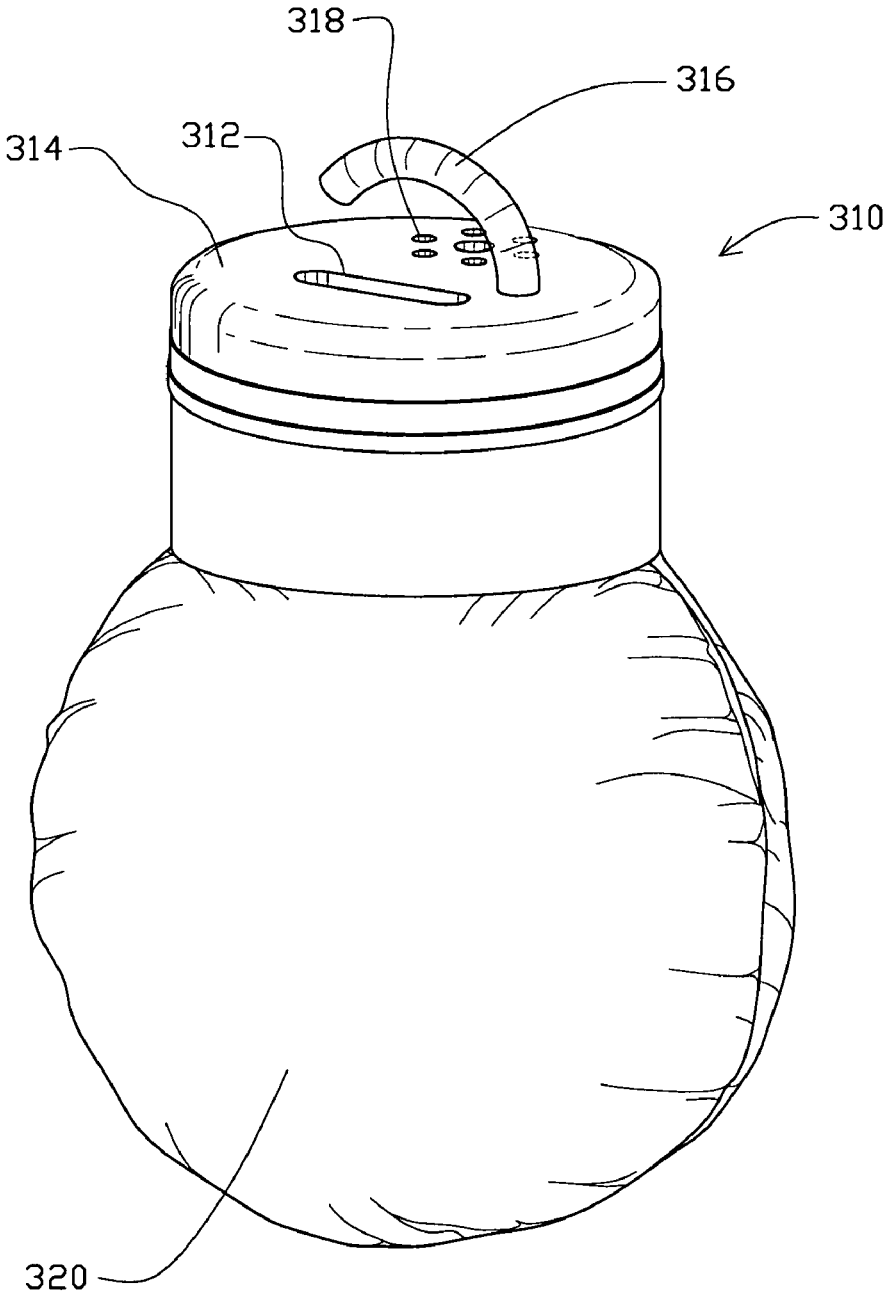
FIG. 3 is a view of the top and front side of the cap attached to an inflatable balloon.

FIG. 3 shows the completed accessory 310 with an inflated balloon 320 attached thereto. The stem 322 of the balloon is shown attached threw the stem hole 312 and may be taped on a top 314 of the cap 310. The coupling 316 is intended to allow the accessory and balloon to take the appearance of a hanging Christmas ornament. When the accessory 310 and ambient-air filled balloon 320 are so coupled and hanging as a single unit, the hook is defined as the top element of the accessory. This set up is known as the upside down position. As shown here, the accessory 310 includes audio holes 318 which allow music from an enclosed music box to be heard more clearly through the accessory 110.

Though the invention has been described with respect to a specific preferred embodiment, many advantages, variations and modifications will become apparent to those skilled in the art upon reading the present application. It is therefore the intention that the appended claims and their equivalents be interpreted as broadly as possible in view of the prior art to include all such variations and modifications.

I claim:

1. An accessory for an inflatable balloon, comprising:
an inflatable balloon having a stem;
an accessory affixable to the stem of the balloon comprising:
a cap, the cap having
a generally round and rigid top piece having an outside edge and at least one stem hole,
a plurality of audio holes, and
a support side including a top edge that couples to the outside edge; and
an electronic music box coupled to the cap.

2. The apparatus of claim 1 wherein the accessory is configured to hang in a position that provides an upside-down appearance.

3. The apparatus of claim 1 further comprising a coupling integrated with the top piece.

4. The apparatus of claim 3 wherein the coupling is an open look hook.

5. The apparatus of claim 3 wherein the coupling is a closed loop hook.

6. The apparatus of claim 1 wherein the cap is made of card stock.

7. The apparatus of claim 1 wherein the support side comprises ornamental designs disposed thereon.

8. The apparatus of claim 1 wherein the musical device is actuated via a mechanical switch.

9. The apparatus of claim 1 wherein the musical device is actuated via a motion-activated switch.

10. The apparatus of claim 1 wherein the musical device is actuated via a motion-detecting switch.

11. The apparatus of claim 1 wherein the accessory is affixed to a support device to hang in an upside-down position.

* * * * *